United States Patent [19]

Winmill

[11] Patent Number: 4,779,795

[45] Date of Patent: Oct. 25, 1988

[54] CONVECTOR ROOM HEATER INCORPORATING A HOT WATER BOILER

[76] Inventor: John A. Winmill, P.O. Box 534, New Plymouth, New Zealand

[21] Appl. No.: 62,701

[22] Filed: Jun. 16, 1987

[30] Foreign Application Priority Data

Jun. 17, 1986 [NZ] New Zealand ..... 216564

[51] Int. Cl.[4] ..... F24B 7/00

[52] U.S. Cl. ..... 237/51; 110/163; 110/234; 122/15; 122/449; 126/101; 126/112; 126/120; 126/374; 236/14; 236/45

[58] Field of Search ..... 110/214, 210, 147, 163, 110/233, 234; 236/1 G, 14, 15 BA, 20 R, 45; 122/449, 15, 14, 17; 126/112, 120, 101, 374; 237/51

[56] References Cited

U.S. PATENT DOCUMENTS 1,472,706 10/1923 Weineck ..... 126/112
4,216,760 8/1980 Wiggins ..... 126/120
4,226,195 10/1980 Lindroos ..... 110/234
4,319,558 3/1982 Thurlo ..... 126/120 X
4,419,942 12/1983 Johnson ..... 110/234
4,422,440 12/1983 Russell ..... 110/163 X
4,497,262 2/1985 Nordine ..... 110/234

*Primary Examiner*—Steven E. Warner
*Attorney, Agent, or Firm*—Bucknam and Archer

[57] ABSTRACT

According to the present invention there is provided a boiler comprising a firebox, a control device controlling the flow of air into the firebox, a water jacket surrounding at least part of the firebox, a sensor to sense the temperature of the water in or being discharged from the water jacket, the sensor being adapted to control directly or indirectly the control device. The sensor can be a temperature sensitive valve associated with the water jacket to control the position of the control device to thereby govern the flow of air to the firebox. The invention further provides a method of providing space heating and hot water from a boiler unit comprising the operation of a boiler unit.

8 Claims, 3 Drawing Sheets

CONVECTOR ROOM HEATER INCORPORATING A HOT WATER BOILER

FIELD OF THE INVENTION

The present invention relates to improvements in and relating to boilers.

BACKGROUND OF THE INVENTION

Up to the present time various proposals have been put forward that combine the functions of a water boiler with space heating.

In this regard the combination water heater/space heaters can be required in various situations e.g. in the supply of room heating as well as supplying hot water for radiators, domestic hot water, spa pools and the like.

The boilers available to the present time have, however, suffered from various disadvantages particularly in respect of the control of water heating/room heating function and/or cost, complexity and efficiency of design.

It is thus an object of the present invention to provide a boiler which overcomes or at least obviates the above disadvantages and/or at least provides the public with a useful choice.

SUMMARY OF THE INVENTION

According to one aspect of the present invention there is provided a boiler comprising a firebox, control means controlling the flow of air into the firebox, a water jacket surrounding at least part of the firebox, sensing means to sense the temperature of said water in or being discharged from the water jacket, the sensing means being adapted to control directly or indirectly the control means.

The sensing means can be a temperature sensitive valve associated with the water jacket to control the position of the control means to thereby govern the flow of air to the firebox.

According to another aspect of the present invention there is provided a method of providing space heating and hot water from a boiler unit comprising the operation of a boiler unit in a manner substantially as hereinafter described.

Further aspects of this invention which should be considered in all its novel aspects, will become apparent from jthe following description given by way of example of possible embodiments thereof.

DESCRIPTION OF THE PREFERRED EMBODIMENTS

In the first embodiment shown in FIGS. 1 to 4 of the accompanying drawings, a boiler/space heater according to one possible embodiment of the invention is shown very diagrammatically with the inward flow of room air being illustrated by arrows A and the outward flow of heated room air being referenced by arrows B. The flow of primary air for combustion is referenced by arrow $A^1$, that of secondary air by arrows D and that of flue gases by arrow C.

Figure 1:
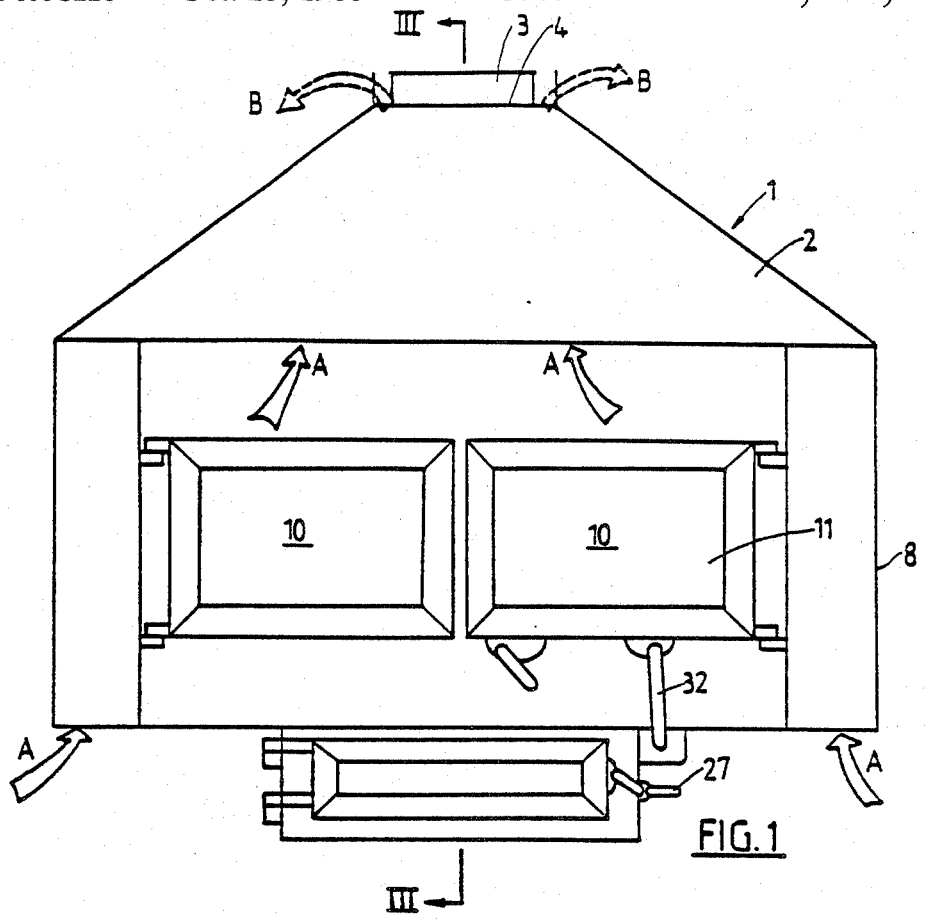
FIG. 1 is a diagrammatic front view of a boiler according to one possible embodiment of the invention.
Figure 2:
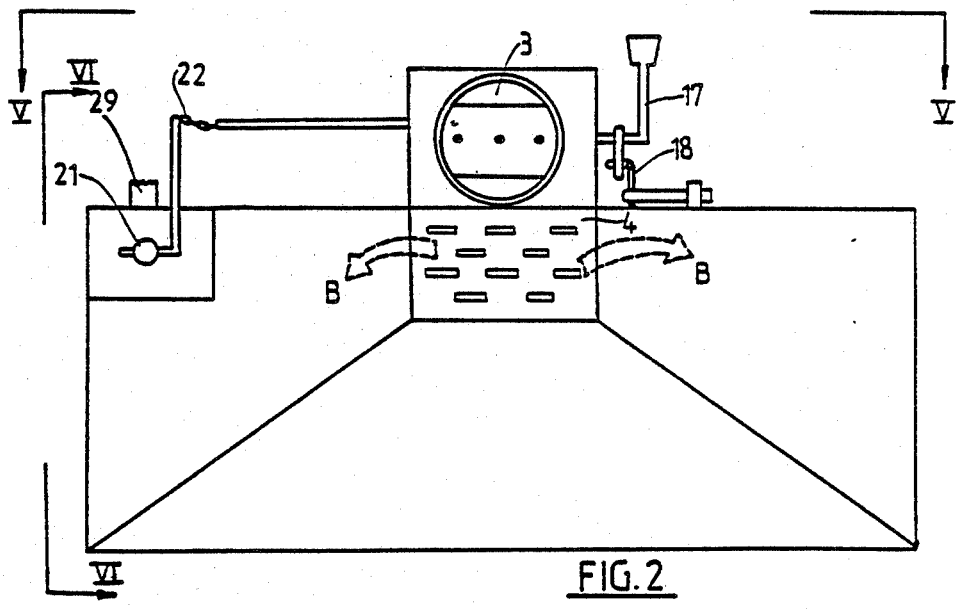
FIG. 2 is a plan view of the boiler of FIG. 1.

The boiler referenced generally by arrow 1 is shown having a substantially frusto-conical upper portion 2 having a flue gas outlet 3 and a heated room air outlet 4. The outlet 4 is shown in FIG. 2 as including a suitable grill or mesh cover.

A bottom portion 8 of the boiler 1 is shown surrounding a water jacket 7 which in turn surrounds a firebox 6. Water enters the jacket 7 at the bottom as indicated by arrow W (FIG. 3) and can be discharged via an outlet 29 (FIG. 2).

At the rear of the boiler 1 is shown an air inlet 5 controlled by a primary air damper 9. Some of the air flowing in the direction indicated by arrow $A^1$, through the air inlet 5, passes into a secondary air duct 20 at the rear of the firebox 6 while the rest of that air flows into the firebox 6 itself through primary air inlet 5A so as to provide the primary air for combustion.

The front of the firebox 6 and casing 8 is shown closed off by a pair of fire doors 10 suitably provided with heatproof glass 11 and a safety bar 32 to prevent inadvertent opening of the fire doors. A bottom portion of the firebox 6 is shown provided with a grate 12. As shown the grate 12 can be a double fire bar grate, with bars 12A and 12B one on top of the other the relative movement between which can close off or open the grate 12. For the burning of wood, the grate can be in a closed position (wood being best burnt on a bed of wood ash) and for coal the grate can be in an open position so as to allow ash to fall through into the ash bin 13 positioned therebelow. For solely a wood burning boiler unit, the ash bin 13 could be omitted, a single closed grate 12 could be provided and the unit could be provided with suitable feet or a pedestal so as to raise the unit from the ground.

Figure 3:
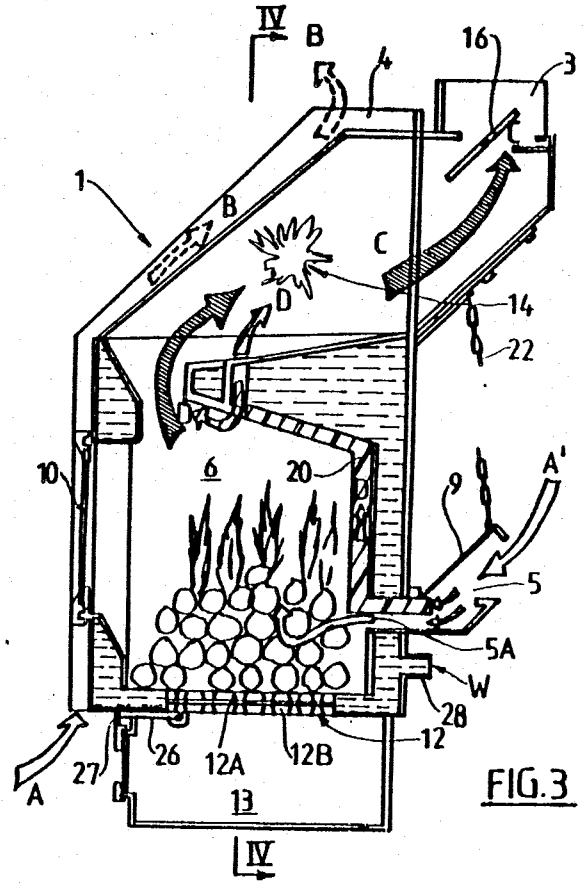
FIG. 3 is a view along arrows III—III of FIG. 1.
Figure 4:
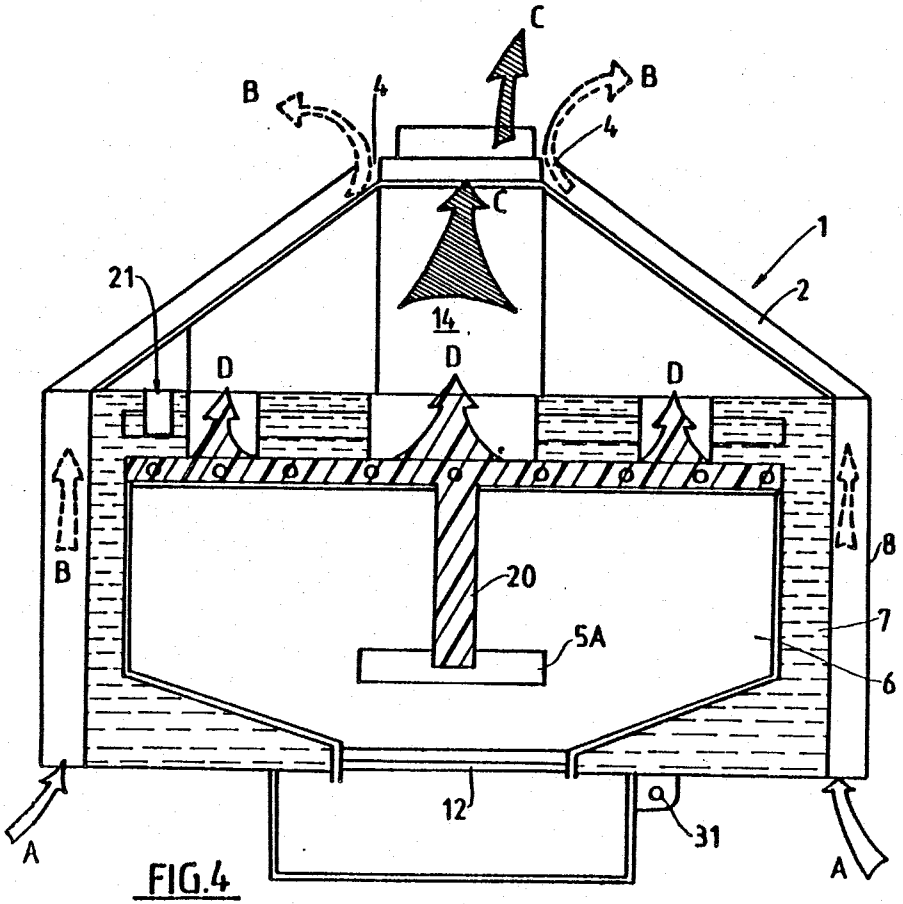
FIG. 4 is a view along arrows IV—IV of FIG. 3.

Referring particularly to FIGS. 3 and 4 of the accompanying drawings, it is seen that with a fire burning in the firebox 6 the gases of combustion pass upwardly in the direction of the flue 3 but in so doing meet with the secondary air D which has been heated. A secondary burn-off of carbons and other products of combustion results so as to control the amount of smoke emission. After this afterburner section, referenced generally by arrow 14, the flue gases pass into the lower part of the flue 3 via a butterfly or other suitable damper 16.

The damper 16 can suitably be controlled manually by means of an external lever 17 which is shown in FIG. 2 connected to a suitable linkage 18 which in turn is connected via linkage 31 to the safety bar 32 of the fire doors 10 so as to prevent the fire doors 10 being opened while the flue damper 16 is in a closed position. This eliminates or at least obviate the problem of backdraft into the room.

Referring also to FIG. 2 particularly, a sensing means 21 which can incorporate a flow control device, such as a valve, is shown provided to adjust the flow of water from the water jacket 7 through outlet 29 after it has been heated to a required temperature. A linkage 22 is shown connecting the sensing means 21 with the primary air damper 9 so that once a desired water temperature has been attained the air damper 9 will be closed off so as to control the rate of combustion in the firebox 6. The combustion within the firebox 6 is thus providing for the supply of hot water at a desired temperature as well as for heated room air exiting into the room through vent 4.

It is envisaged that a boiler 1 according to one possible embodiment of the invention can provide up to 800 square feet of radiators together with domestic hot water and if dry wood is used the boiler 1 produces/in the region of 120,000 B.T.U.'s of hot water and approximately 40,000 B.T.U.'s of hot air. These figures are of course given merely by way of illustration of one size of boiler and in respect of the use of one type of fuel.

The present invention broadly comprises a combined water heater/space heater. However, whilst such functions are those of a preferred embodiment of the invention it will be appreciated by those skilled in the engineering arts that other functions would be possible, if necessary with appropriate changes being made in the boiler design. For example, while water and air are the fluids being heated in the embodiment of the invention as described alternative fluids could be utilised.

Figure 6:
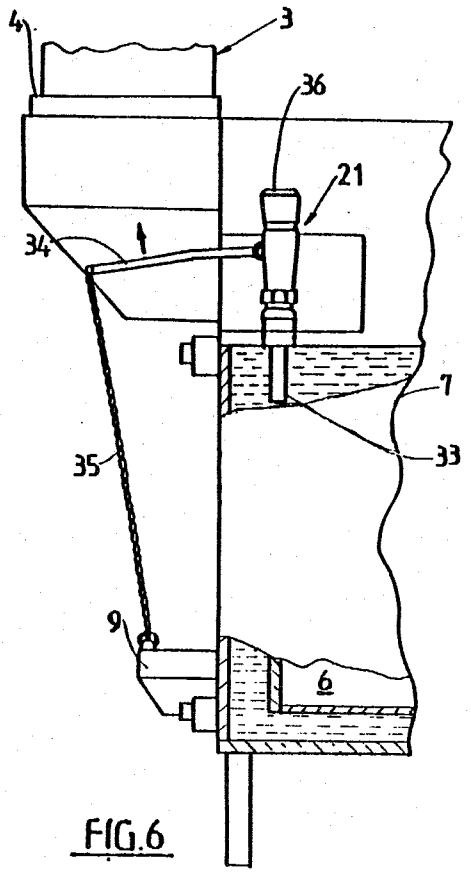
FIG. 6 is a sectional view along arrows VI—VI of FIG. 2 with the alternative means of controlling operation of the boiler as shown in FIG. 5.
Figure 5:
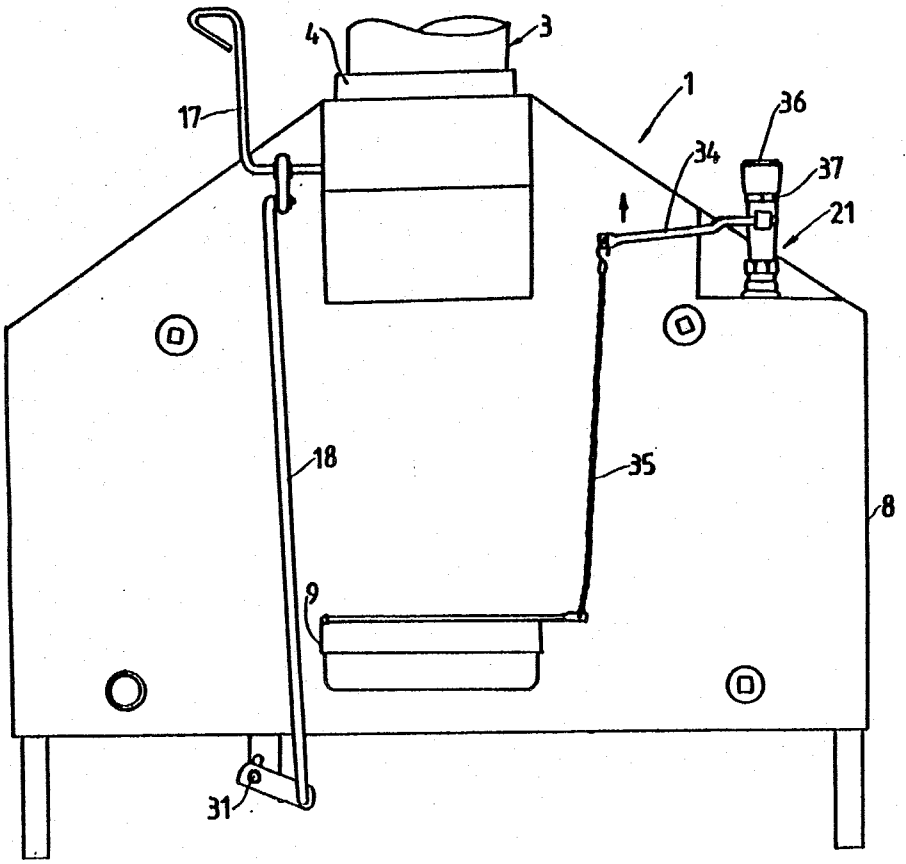
FIG. 5 is a rear view in the direction of arrows V—V of FIG. 2 showing an alternative means of controlling the operation of a boiler according to the invention.

Referring to FIGS. 5 and 6 which show an alternative embodiment of boiler/space heater according to the invention. In this embodiment the parts of the boiler are, for ease of reference, indicated by the same numerals as arae similar parts of the first embodiment.

In the alternative embodiment a preferred means for controlling operation of the boiler is shown. The means includes a sensing means 21 fitted so that a sensing bulb 33 thereof is within the water jacket 7. Preferably the sensing means 21 is positioned near or at an upper edge of the water jacket 7 to sense the temperature of the water at its hottest point. The sensing means 21 including means 36 in the form of a rotatable knob for adjusting the temperature setting on scale 37 thereof as required. In use the lever arm 34 is initially set at an angular orientation relative to the sensing means so that changes measured by the sensing bulb are converted within the means 21 into angular movement of the arm 34. The arm 34 has at its free end 35 a connection for a linkage or chain 35 the other end of which is connected to the primary air damper 9. In use the setting of the sensing means 21 is adjustable and is advantageously set with the boiler operating at 60° C. to give a desired opening of the damper 9 (about 2 mm) for normal operating conditions.

In the construction shown in FIGS. 5 and 6 the boiler/space heater is a wood burner version without grate 12. In this construction the water jacket 7 extends across the base of the firebox 6 as well as on the sides thereof.

If higher/lower temperature of water is required the regulator setting is adjusted and the opening/closing movement of the damper 9 automatically regulates burner temperature. As water is drawn of from valve 29 the temperature of the jacket 7 reduces thus opening the damper 9 and increasing the amount of combustion as required.

Where in the aforegoing description reference has been made to specific components or integers of the invention having known equivalents then such equivalents are herein incorporated as if individually set forth.

Although this invention has been described by way of example and with reference to possible embodiments thereof it is to be understood that modifications or improvements can be made thereto without departing from the scope or spirit of the appended claims.

I claim:

1. A convector room heater incorporating a hot water boiler, the boiler comprising a firebox, said firebox consisting of a generally rectangular lower portion and a frusto-conical upper portion, the upper portion having a flue gas outlet therein, the firebox having control means for controlling the flow of air into said firebox, the firebox having a water jacket surrounding the sides and the rear and at least part of the front, top and bottom of said lower portion, said firebox and said frusto-conical upper portion being surrounded by an air jacket having a room air outlet, the firebox having a combustion air inlet in the rear thereof, the air inlet having in association therewith a primary air damper, said control means adjusting the flow of air into said firebox, the air inlet having therein a secondary air duct for directing air for secondary combustion in said frusto-conical upper portion of the firebox, the water jacket having sensing means to sense the temperature of said water in or being discharged from said water jacket, said sensing means controlling the opening or closing of said primary air damper to thereby govern the flow of air to the firebox and control combustion therein.

2. A convector room heater incorporating a hot water boiler as claimed in claim 1 wherein the sensing means is a temperature sensitive means associated with the water jacket.

3. A convector room heater incorporating a hot water boiler as claimed in claim 2 wherein the sensing means is a temperature sensitive valve associated with the water jacket to control the position of the control means to govern the flow of air to the firebox and thereby control combustion.

4. A convector room heater incorporating a hot water boiler as claimed in claim 3 wherein the sensing means is a temperature sensitive valve associated with the water jacket to control the flow of heated water from the outlet.

5. A convector room heater incorporating a hot water boiler as claimed in claim 4 wherein the front of the firebox has at least one fire door with a safety bar for preventing inadvertent opening thereof.

6. A convector room heater incorporating a hot water boiler as claimed in claim 5 wherein the flue gas outlet has associated therewith a manually operated damper.

7. A convector room heater incorporating a hot water boiler as claimed in claim 6 wherein the bottom of said firebox has grate means and an ash bin positioned for use thereunder with coal and like fuels.

8. A method of providing space heating and hot water from a convector room heater incorporating a hot water boiler unit comprising the operation of a boiler, the boiler comprising a firebox, said firebox consisting of a generally rectangular lower portion and a frusto-conical upper portion, the upper portion having a flue gas outlet therein, the firebox having control means for controlling the flow of air into said firebox, the firebox having a water jacket surrounding the sides and the rear and at least part of the front, top and bottom of said lower portion, said firebox and said frusto-conical upper portion being surrounded by an air jacket having a room air outlet, the firebox having a combustion air inlet in the rear thereof, the air inlet having in association therewith a primary air damper, said control means adjusting the flow of air into said firebox, the air inlet having therein a secondary air duct for directing air for secondary combustion in said frusto-conical upper portion of the firebox, the water jacket having sensing means to sense the temperature of said water in or being discharged from said water jacket, said sensing means controlling the opening or closing of said primary air damper to thereby govern the flow of air to the firebox and control combustion therein.

* * * * *